United States Patent [19]

Lattmann et al.

[11] 4,411,562

[45] Oct. 25, 1983

[54] APPARATUS AND METHOD FOR SEPARATING OPENED END FLOCKS FROM A TRANSPORTING AIR STREAM

[75] Inventors: Werner Lattmann; Robert Moser, both of Winterthur, Switzerland

[73] Assignee: Riter Machine Works, Ltd., Winterthur, Switzerland

[21] Appl. No.: 8,699

[22] Filed: Jan. 30, 1979

Related U.S. Application Data

[63] Continuation of Ser. No. 701,800, Jul. 1, 1976, abandoned.

[30] Foreign Application Priority Data

Jul. 16, 1975 [CH] Switzerland ..... 9296/75

[51] Int. Cl.[3] ..... B65G 53/40

[52] U.S. Cl. ..... 406/157; 19/105; 28/289; 406/171; 406/175

[58] Field of Search ..... 302/26, 28, 59, 61, 302/63; 55/418; 137/83, 815, 835, 836, 841; 141/11, 69, 70; 53/116, 117; 28/288, 289; 19/105, 159 R; 406/154, 157, 168, 171, 175, 181

[56] References Cited

U.S. PATENT DOCUMENTS

| | | | |
|---|---|---|---|
| 2,257,572 | 9/1941 | Radue | 302/60 |
| 2,721,371 | 10/1955 | Hodkinson et al. | 53/116 |
| 2,845,661 | 8/1958 | Svende et al. | 302/61 X |
| 2,863,493 | 12/1958 | Snow et al. | 425/6 X |
| 3,458,237 | 7/1969 | Noe | 302/28 |
| 3,599,848 | 8/1971 | Thumm et al. | 226/7 |
| 3,708,210 | 1/1973 | Stähel et al. | 302/59 |
| 3,865,439 | 2/1975 | Moser et al. | 302/59 |

*Primary Examiner*—James L. Rowland

*Attorney, Agent, or Firm*—Kenyon & Kenyon

[57] ABSTRACT

The connecting duct which directs the flock-laden air stream into the chute is provided with a restriction as well as with a ring duct for directing air impulses into the duct via openings on opposite sides of the duct. The restriction causes the air stream to accelerate and, since the air flow is closer to one opening, rather than the other, a reduced pressure is created on that side. This, in turn, causes a pulse of air to travel from one end of the ring duct to the other. The air pulse continues into the connecting duct to deflect the flock-laden air stream towards the other opening. This sequence then continues in rapid fashion to allow an even deposit of the flock in the chute.

21 Claims, 3 Drawing Figures

APPARATUS AND METHOD FOR SEPARATING OPENED END FLOCKS FROM A TRANSPORTING AIR STREAM

This is a continuation of application Ser. No. 701,800 filed July 1, 1976, now abandoned.

This invention relates to an apparatus and method for separating opened fiber flocks from a transporting air stream.

Heretofore, various techniques have been known for separating and depositing opened fiber flocks in chutes for further processing. In many cases, use has been made of pneumatic equipment in order to transport the fiber flocks, for example from an opener to one or more vertical chutes. Such equipment generally includes a transporting duct which conveys a flock-laden air stream to a series of depositing chutes each of which is provided with openings maintained free for draining air and for retaining the fiber flocks so that a fiber flock column can be formed therein.

In preparatory plants for spinning, for example a flock-laden transporting air stream is guided into depositing chutes for depositing of the fiber flocks therein while the transporting air is drained from the chute above the deposited flock column. Chutes of this type are usually used upstream from flock cleaning machines or from cards and the flock material is usually withdrawn continuously via take-off rolls from the depositing chute and transferred e.g. into a card for further processing. In order to ensure that the card can produce a uniform fiber web, the fiber flocks must be withdrawn uniformly from the chute. For this, it is a necessity to fill the chute uniformly, i.e. the flock filling height must be the same across the whole chute cross-sectional area in such a manner that the same flow and pressure conditions prevail and that the same flock weight load prevails across the whole length of the take-off rolls.

If the transporting air stream carrying the fiber flocks is guided without control into a depositing chute, an extremely uneven flock deposition results. Thus, arrangements of pneumatically and/or mechanically adjustable deflection means between the transporting duct and the chute have been provided, such as described e.g. in U.S. Pat. No. 3,865,439 and Swiss Pat. CH-PS No. 546,833. In addition to the high cost of such means per se, these deflection means additionally require expensive control devices which have a disadvantage in reacting only after a certain time lag. Thus, even with such deflection means, the same filling height of the flock column across the whole cross-sectional area of the chute cannot be maintained at all times. Further, another disadvantage resides in the fact that the transporting air stream can be guided to the chute only at a bias.

Accordingly, it is an object of the invention to create a simple, economically feasible chute filling method and apparatus which is stable and reliable in operation.

It is another object of the invention to provide an apparatus void of movable parts for filling a chute with fiber flocks in a uniform manner.

It is another object of the invention to fill a depositing chute in a uniform manner with a transporting air stream which can be guided to the chute in any direction desired.

It is another object of the invention to ensure the same flock filling degree across the whole cross-section area of a pneumatically fed chute at all times.

Briefly, the invention provides an apparatus and method wherein a fiber flock laden air stream is moved to and fro in rapid sequence pneumatically across the whole cross-section area of the chute.

The apparatus for separating the opened fiber flocks from the transporting air stream comprises a transporting duct for the air stream, a chute head for receiving at least a part flow of the flock laden air stream and a connecting duct communicating the tranporting duct with the chute head for delivering the part flow to the chute head. In addition, the apparatus includes a restriction within the connecting duct in the flow path of the part flow which restriction abruptly enlarges to a larger cross-sectional area in the connecting duct downstream of the restriction as well as a means for directing air impulses into the connecting duct downstream of the restriction. This latter means directs the air impulses from two opposite sides of the duct in order to move the part flow to and fro across the chutehead.

In one embodiment, the means for directing the air impulses into the connecting duct is in the form of a closed ring duct which is connected to the opposite sides of the connecting duct. During operation, the flock-laden air stream flows through the restriction and passes over one of the openings in the connecting duct to the ring duct. This causes a lower pressure in that end of the ring duct which, in turn, causes air to be drawn from the connecting side into the opposite end of the ring duct. This drawn in air then flows through the ring duct and through the first-mentioned opening into the connecting duct. The air impulse then impinges on the air stream and deflects the air stream towards the opposite opening where the same effects as above take place. A rapid sequence of air stream deflections then take place causing a to and fro motion across the chute head.

In another embodiment, the means for directing the flock-laden air stream to and fro across the chute head includes a reservoir of compressed air in a ring duct, a source of compressed air connected to the reservoir and a control unit connected to the reservoir to selectively open and close the reservoir to each of the opposite sides of the connecting duct.

The apparatus also includes a chute vertically below the chutehead to receive the delivered part flow. This chute is of any suitable type having a wall with openings for the passage of air and the retention of fiber flocks. During operation of the apparatus, the to and fro motion of the delivered air flow effects a uniform deposition of the fiber flocks in the chute.

In another embodiment, the restriction can be adjustable longitudinally of the connecting duct and can consist of profile bodies which can be exchanged. The ringduct can also consist of a flexible hose of adjustable length. Advantageously, two opposite chute head walls can be of convex curvature is such a manner that they expand under decreasing curvature continually to the width of the chute.

The method of the invention employs the steps of directing a fiber flock laden air stream from the transporting duct into the depositing chute and moving the flock laden air stream to and fro in rapid sequence between two opposite sides of the chute across the cross-section of the chute to obtain a uniform deposition of the fiber flock therein. To this end, the air stream is accelerated prior to movement into the chute while air impulses are periodically directed onto the moving air stream alternately from opposite sides to move the air stream to and fro across the chute. These movements are effected within a time lapse of fractions of a second.

These and other objects and advantages of the invention will become more apparent from the following detailed description and appended claims taken in conjunction with the accompanying drawings in which:

Figure 1:
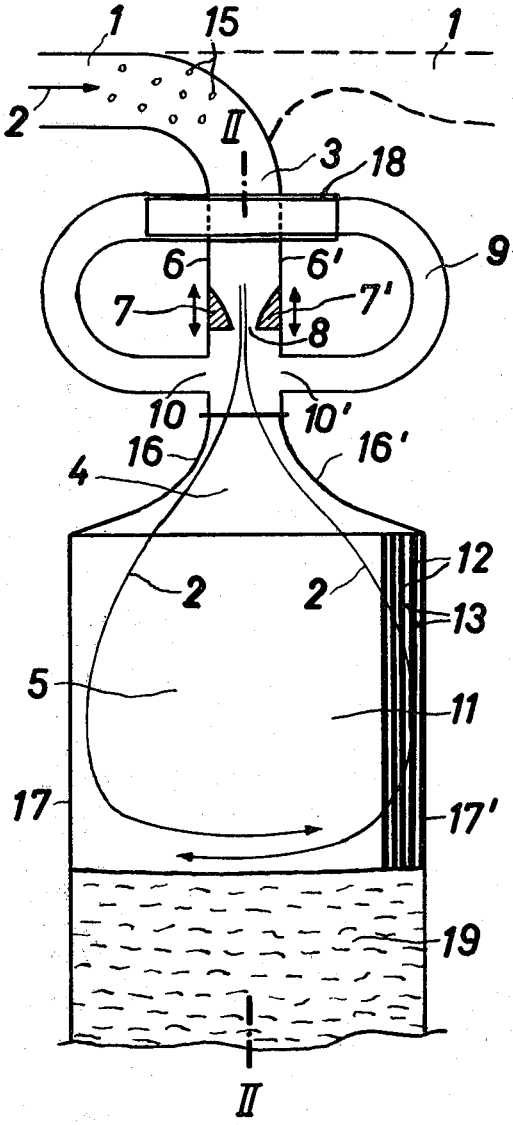
FIG. 1 illustrates a cross-sectional view of an apparatus according to the invention.

Referring to FIG. 1, the apparatus for separating opened fiber flocks 15 from a transporting air stream 2 includes a transporting duct 1 for the air stream 2, and means for conveying at least a part of the flock-laden stream from the duct 1 to a feed chute 5 for receiving and holding the fiber flocks in a flock column 19. This means includes a chute head 4 on the chute 5 and a connecting duct 3 which communicates the transporting duct 1 with the chute head 4 of the depositing or fuel chute 5. The transporting duct 1 can be extended, as indicated in broken lines, in order to supply a plurality of subsequent chutes with fiber flocks.

The connecting duct 3 which delivers the flow from the transporting duct 1 to the chute head 4 is of square or rectangular cross-section and has a pair of profile bodes 7, 7′ arranged on two opposite duct walls 6, 6′ to form a restriction or nozzle 8 in the flow path. The profile bodies 7, 7′ are adjustably mounted in the connecting duct to move longitudinally and are also interchangeable. By correspondingly shaping the profile bodies 7, 7′, an aerodynamically advantageous merging into the restriction 8 is effected, the surface of the profile bodies 7, 7′ restricting the cross-section of the duct being progressively curved. The profile bodies 7, 7′ shown can also be replaced by other bodies of differently shaped surface. Furthermore, the profile bodies 7, 7′ are constructed in such a manner that the cross-section of the duct 3 abruptly enlarges to a larger cross-sectional area downstream of the restriction 8, i.e. the cross-section becomes equal to the normal cross-section of the duct 8.

In addition, a means is provided for directing air pulses into the connecting duct 3 downstream of the restriction 8 from two opposite sides in order to move the flow to and fro across the chute head 4. This means is in the form of a flexible ring duct 9 which connects two opposite openings 10, 10′ in the duct wall 6, 6′. As shown, the ring duct 9 is of adjustable length via a telescoping device 18. The range of movement of the profile bodies extends almost to these openings 10, 10′.

The chute 5 which is of rectangular cross-section has two narrow sidewalls on the same side as the duct walls 6, 6′ and two wide sidewalls, one of which serves as a back wall 11. This back wall 11 is provided with a plurality of openings to allow flow through of air while retaining the fiber flocks.

As shown, the back wall 11 has equi-distantly arranged lamellae or strips 12, as indicated in FIG. 1 on the right hand side, which define small vertical slots 13 which merge into a drain duct 14. The width of the slots 13 is chosen to be smaller than the size of the fiber flocks 15.

The chute head 4 contains two side walls 16, 16′ of convex curvature, merging into the small side walls 17, 17′ of the chute 5, the curvature of the side walls 16, 16′ decreasing towards the chute walls 17, 17′. The walls 16, 16′ thus define a passage of increasing width from the duct 3.

As shown, the duct 2, chute head 4 and chute 5 lie in a common plane.

In operation, the transporting air stream 2 carrying fiber flocks 15 is guided under above-atmospheric pressure from the transporting duct 1 through the connecting duct 3 and through the restriction 8 between the profile bodies 7, 7′ into the chute head 4 and from there into the chute 5. In this process, a turbulent free stream is generated which emerges from the restriction 8 and which, if the ring-duct 9 would not be present, would approach one of the walls 16, 16′ of the chute head 4 and would flow along this wall to the chute 5. The walls 16, 16′ by being arranged at the same distances from the restriction 8 causes the system to be bi-stable. A pressure impulse is then directed from the corresponding opening 10, 10′ onto the free stream to switch the stream over to the other one of the walls 16, 16′. As the ring-duct 9 merges into both openings 10, 10′, the switching over occurs automatically, the system functioning as an oscillator; the switching actions being effected with fractions of seconds.

After passing through the restriction 8, the flock laden air stream 2 approaches e.g. the right hand wall 16 of the chute head 4. The air stream now flows along the wall 16′ as indicated in FIG. 1 and flows on along the right hand side into the chute 5 and over the surface of a flock column 19. The fiber flocks 15 are deposited here while the transporting air 20 freed of the flocks 15 escapes through the slots 13 into the drain duct 14.

As the transporting air stream 2 now adheres to the right hand wall 16′, a lower pressure is generated in the right-duct 9 at the opening 10′ than in the duct 3, owing to the flow of the air stream across the opening 10′, whereas a higher pressure prevails in the ring-duct 9 behind the opening 10. Thus, a pressure impulse forms for equalizing this pressure differential in the ring-duct 9. This pressure impulse is then propagated from the opening 10 to the opening 10′ and now causes the transporting air stream 2 to switch over to the left hand side wall 16 of the chute head 4. At this time, a lower pressure is generated in the ring-duct 9 behind the opening 10 while a higher pressure prevails at the opening 10′. Thus, a pressure impulse is propagated in the ring-duct 9 from the opening 10′ to the opening 10 to again switch over the transporting air stream 2. In this manner, the transporting air stream 2 keeps oscillating between the two curved walls 16, 16′ of the chute head 4 and between the small side walls 17, 17′ of the chute 5 and, thus, also keeps oscillating across the cross-section of the chute 5. This causes an extremely uniform deposition of the fiber flocks to be achieved; the to and fro movement of the air stream being effected within fractions of a second.

The oscillation frequency of the transporting air stream depends on the diameter and on the length of the ring-duct 9 and, thus, the frequency can be varied by adapting these two dimensions.

The adaptability of the longitudinal position of the individual profile bodies 7, 7′ is advantageous as asymmetric influences caused by the duct system on the transporting air stream 2 can be offset. Thus, a symmetrical oscillation can be achieved. The flexibility of the ring-duct 9 is advantageous in that the ring-duct 9 can be adapted to the space situation available and to the relative position of the duct in the telescoping device 18.

Figure 3:
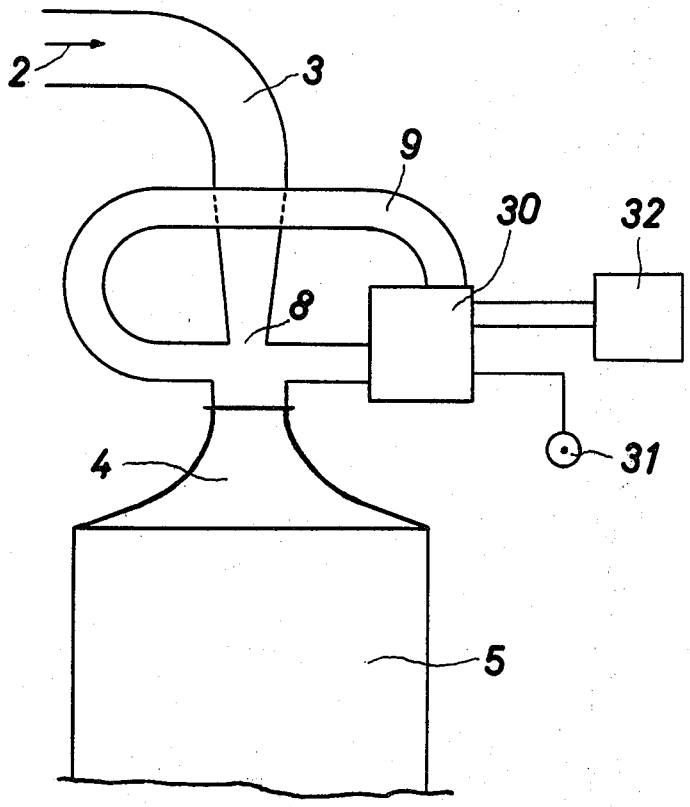
FIG. 3 illustrates a schematic view of a modified apparatus according to the invention.

Referring to FIG. 3, wherein like reference characters indicate like parts as above, the means for directing the air impulses into the air stream may also use a reservoir of compressed air 30, connected with a source of compressed air 31 and with a control unit 32. As shown, the reservoir 30 is arranged in the ring-duct 9. In this embodiment, the flock-laden air stream 2 is switched over at a restriction 8 formed by the walls of the connecting duct 3 by using additional air. During operation, the reservoir of compressed air 30 receives the command impulses for activating the corresponding pressure impulse from the control unit 32. This embodiment presents the advantage that the time delay for one to and fro movement of the air stream 2 is independent of the system and can be pre-set at the control unit 32.

In a further embodiment (not shown), the ring duct can be dispensed with, in which case, the switching of air stream can be effected by controlled pressure impulses from a source of compressed air directly.

Figure 2:
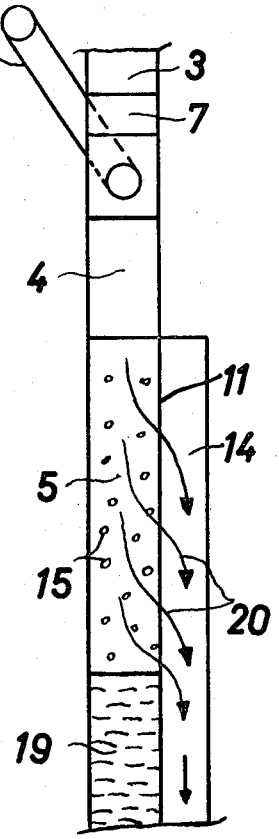
FIG. 2 illustrates a view taken on line II—II of FIG. 1.

By using the apparatus for implementing the method described, numerous advantages can be achieved. For example, as the chute head receives the air stream from above, the type of the arrangement of the connecting duct has no influence. Thus, the apparatus can be arranged independently of the transporting duct, i.e. supply duct, direction. The transporting duct thus can be arranged, e.g. along or parallel to or at a bias (at right angles) to the following spinning preparatory machine. Also, in the apparatus according to FIGS. 1 and 2, an air stream moving to and fro at a high frequency is generated without the necessity of using movable parts or special electrical or mechanical control elements and without need of any additional supply of pneumatic energy for control purposes. Thus, a simple, reliable apparatus can be achieved, which is stable over a long period of time and not subject to disturbances.

What is claimed is:

1. An apparatus for separating opened fiber flocks from a transporting air stream comprising a transporting duct for a flock-laden transporting air stream;

a chute head for receiving at least a part flow of the flock-laden air stream;

a connecting duct communicating said transporting duct with said chute head for delivering said flow from said transporting duct to said chute head;

a restriction within said connecting duct in the flow path of said flow, said restriction abruptly enlarging to a larger cross-sectional area in said connecting duct downstream of said restriction; and a closed ring duct connected to two opposite sides of said connecting duct downstream from said restriction to maintain said sides in continuous open communication with each other therethrough for directing air impulses into said connecting duct to move said flow to and fro in rapid sequence across said chute head.

2. An apparatus as set forth in claim 1 wherein said ring duct is a flexible hose.

3. An apparatus as set forth in claim 1 wherein said ring duct is of adjustable length.

4. An apparatus as set forth in claim 1 wherein said chute head has a pair of opposite walls, each said wall being disposed on the same side as a respective one of said connecting duct and being of convex curvature, said chute head walls defining a passage of continuously increasing width extending from said connecting duct.

5. An apparatus as set forth in claim 4 wherein each of said convex walls is of decreasing curvature in a direction away from said connecting duct.

6. An apparatus as set forth in claim 4 wherein said chute head is of rectangular cross-section and said opposite walls are the narrowest walls of said chute.

7. An apparatus for separating opened fiber flocks from a transporting air stream comprising a transporting duct for a flock-laden transporting air stream;

a chute head for receiving at least a part flow of the flock-laden air stream;

a connecting duct communicating said transporting duct with said chute head for delivering said flow from said transporting duct to said chute head;

a restriction within said connecting duct in the flow path of said flow, said restriction abruptly enlarging to a larger cross-sectional area in said connecting duct downstream of said restriction;

a chute vertically below said chute head to receive said part flow from said connecting duct; and a closed ring duct connected to two opposite sides of said connecting duct downstream from said restriction to maintain said sides in continuous open communication with each other therethrough for directing air impulses into said connecting duct to move said flow to and fro in rapid sequence across said chute head to obtain a uniform deposition of fiber flocks in said chute.

8. An apparatus as set forth in claim 7 wherein said chute includes a wall having openings therein for passage of air therethrough and retention of fiber flocks within said chute.

9. An apparatus as set forth in claim 7 wherein said chute is of rectangular cross-section and has a pair of narrow side walls and a pair of wide side walls, said narrow side walls being on the same side as said opposite sides of said connecting duct.

10. In an apparatus for depositing fiber flocks pneumatically within a chute, the combination comprising a connecting duct for delivering a flow of flock-laden air into said chute;

a restriction within said duct in the flow path of said flow; and a closed ring duct connected to two opposite sides of said duct downstream from said restriction to maintain said sides in continuous open communication with each other therethrough for directing air impulses into said duct to move said flow to and fro in rapid sequence across said chute to obtain a uniform deposition of fiber flocks in said chute.

11. An apparatus for separating opened fiber flocks from a transporting air stream comprising a transporting duct for a flock-laden transporting air stream;

a chute head for receiving at least a part flow of the flock-laden air stream;

a connecting duct communicating said transporting duct with said chute head for delivering said flow from said transporting duct to said chute head;

a restriction within said connecting duct in the flow path of said flow, said restriction being adjustably mounted in said connecting duct to move longitudinally thereof and abruptly enlarging to a large cross-sectional area in said connecting duct downstream of said restriction; and means for directing air impulses into said connecting duct downstream of said restriction from two opposite sides of said connecting duct to move said flow to and fro across said chute head.

12. An apparatus for separating opened fiber flocks from a transporting air stream comprising a transporting duct for a flock-laden transporting air stream;

a chute head for receiving at least a part flow of the flock-laden air stream;

connecting duct communicating said transporting duct with said chute head for delivering said flow from said transporting duct to said chute head;

a restriction within said connecting duct in the flow path of said flow, said restriction including a pair of interchangeable profiled bodies and abruptly enlarging to a larger cross-sectional area in said connecting duct downstream of said restriction; and means for directing air impulses into said connecting duct downstream of said restriction from two opposite sides of said connecting duct to move said flow to and fro across said chute head.

13. An apparatus for feeding fiber flocks to a spinning preparatory machine, said apparatus comprising a feed chute for receiving and holding fiber flocks in a flock column;

a chute head on said chute for receiving at least a part flow of a flock-laden air stream;

a connecting duct communicating with said chute head for delivering said part flow thereto; and means for periodically directing air impulses onto said part flow to cause movement of said part flow to and fro in rapid sequence from one side to an opposite side of said chute head to produce a continuously uniform distribution of fiber flocks in said feed chute during filling of said chute with said connecting duct functioning as a bi-stable oscillator in response to said impulses.

14. An apparatus as set forth in claim 13 wherein said means comprises a closed ring duct connected to two opposite sides of said connecting duct to maintain said sides in continuous open communication with each other therethrough.

15. An apparatus as set forth in claim 13 wherein said means comprises a source of compressed air connected to two opposite sides of said connecting duct and means for selectively opening and closing said source to said sides respectively.

16. An apparatus as set forth in claim 13 wherein said connecting duct includes a restriction in the flow path of said part flow, said restriction abruptly enlarging to a larger cross-sectional area downstream of said restriction, and wherein said means is disposed to direct said air impulses into said part flow downstream of said restriction.

17. An apparatus as set forth in claim 13 wherein said head has a gradually increasing width in a direction towards said chute and said connecting duct chute head and chute lie in a common plane.

18. A method of separating opened fiber flocks from a transporting air stream into a deposition chute, said method comprising the steps of directing a fiber flock laden air stream from a transporting duct into the depositing chute over period of time, accelerating said moving air stream prior to movement into the chute, and periodically directing air impulses onto the fiber flock-laden air stream alternately from two opposite sides during said time to move the fiber flock-laden air stream to and fro in rapid sequence between two opposite sides of the chute across the cross-section of the chute to obtain a uniform deposition of fiber flock therein during filling of said chute.

19. A method as set forth in claim 18 which further comprises the step of periodically directing lateral pressure impulses onto said moving air stream to move said air stream to and fro across the chute.

20. A method as set forth in claim 18 wherein said impulses are obtained from a controlled source of compressed air.

21. A method as set forth in claim 18 wherein said to and fro movement is effected within a time lapse of fractions of a second.

* * * * *